US006182677B1

(12) United States Patent
Pignataro

(10) Patent No.: US 6,182,677 B1
(45) Date of Patent: Feb. 6, 2001

(54) CLEANOUT FITTING FOR AIR CONDITIONER EVAPORATOR DRAINS

(76) Inventor: James Pignataro, 14815 E. Bobcat Plz., Fountain Hills, AZ (US) 85268

( * ) Notice: Under 35 U.S.C. 154(b), the term of this patent shall be extended for 0 days.

(21) Appl. No.: 09/478,527

(22) Filed: Jan. 6, 2000

(51) Int. Cl.[7] ..... B08B 1/00; B08B 3/04; B08B 9/04; B08B 9/027; B08B 9/032

(52) U.S. Cl. ..... 137/15.05; 15/104.05; 15/104.16; 62/303; 134/166 C; 137/240; 137/244; 137/245.5

(58) Field of Search ..... 15/104.03, 104.05, 15/104.16; 62/303; 134/99.2, 166 C; 137/15.05, 15.07, 240, 242, 244, 245, 245.5; 222/148

(56) References Cited

U.S. PATENT DOCUMENTS

| | | | | |
|---|---|---|---|---|
| 1,159,977 | * | 11/1915 | Massey et al. | 137/242 |
| 1,176,394 | * | 3/1916 | Mitchell | 137/242 |
| 1,274,103 | | 7/1918 | Story | 137/240 |
| 1,349,594 | * | 8/1920 | Wafer et al. | 137/242 |
| 1,553,034 | * | 9/1925 | Donnelly | 137/242 |
| 1,624,168 | * | 4/1927 | Gschwind | 137/245.5 |
| 1,655,796 | | 1/1928 | Murphy et al. | 137/240 |
| 4,203,460 | | 5/1980 | Priese | 137/240 |
| 4,553,566 | | 11/1985 | Barclay et al. | 137/625.11 |
| 4,898,201 | * | 2/1990 | Conley et al. | 137/245.5 |
| 4,938,246 | * | 7/1990 | Conley et al. | 137/244 |
| 4,998,412 | | 3/1991 | Bell | 62/303 |
| 5,085,244 | | 2/1992 | Funk | 137/240 |
| 5,722,458 | | 3/1998 | Potter | 137/240 |
| 5,964,238 | * | 10/1999 | Junkin | 137/240 |
| 6,041,611 | * | 3/2000 | Palmer | 137/240 |
| 6,068,023 | * | 5/2000 | Potter | 137/625.47 |

FOREIGN PATENT DOCUMENTS

| | | |
|---|---|---|
| 482593 | 4/1952 | (CA) . |
| 2212597 | 7/1989 | (GB) . |

* cited by examiner

*Primary Examiner*—George L. Walton
(74) *Attorney, Agent, or Firm*—Richard C. Litman

(57) ABSTRACT

A cleanout fitting for air conditioner evaporator drains facilitates the mechanical cleanout and hydraulic flushing of the entire drain line from an air conditioner evaporator unit, or air handler. The present fitting essentially comprises an asymmetric T configuration, with a shutoff valve in one side of the crossmember of the T and a removable cap in the opposite end of the crossmember. The fitting is normally configured with the cap in place to block drainage therefrom, and with the valve open to permit flow from the evaporator pan through that crossmember side and out the stem of the T to an appropriate drain system. When the line becomes blocked and causes water in the evaporator pan to back up, the plug is removed, allowing a mechanical cleanout tool (snake, etc.) to be passed straight through the crossmember of the T and its open valve, to the evaporator pan. After confirming that this portion of the system is open, the valve is closed and water under pressure (as with a garden hose) is used to flush out the remainder of the T and its connected drain line, to the drain. The removable plug is preferably configured identically to the male end of a conventional garden hose with its rolled threads, to facilitate the connection of such a hose into the mating internally threaded end of the T crossmember. The present fitting may be formed of PVC plastic material, or other suitable and economical material as desired.

16 Claims, 4 Drawing Sheets

CLEANOUT FITTING FOR AIR CONDITIONER EVAPORATOR DRAINS

BACKGROUND OF THE INVENTION

1. Field of the Invention

The present invention relates generally to plumbing and other fittings in fluid lines or pipes in stationary structures, and more specifically to a cleanout fitting for installing in an evaporator drain line in an air conditioner system in a residence, office building, or other stationary structure. The present fitting allows water or air under high pressure to be forced through the line downstream of the evaporator pan without flowing into the pan, and also allows the line to the pan to be cleaned out with a plumber's cleanout tool or "snake" by means of a selectable valve.

2. Description of the Related Art

All air conditioning systems provide the same final result for air being processed or conditioned thereby, with the air being chilled as a result of contact with the very cold coils of the evaporator unit. In nearly every case, the evaporator coils are at a temperature very close to freezing, in order to impart the maximum cooling effect to the air. This results in much of the moisture which is being carried by the air, condensing out as the air is chilled. Accordingly, nearly all air conditioning evaporator units are provided with a drain pan and a drain line for draining condensed water from the area of the evaporator.

A problem occurs when the drain line becomes partially or completely blocked by dirt, dust, etc., over some period of time. Condensed water will then back up in the evaporator pan, and spill over into adjacent areas. Such evaporator drain line blockages must be taken care of quickly, in order to avoid water damage to the surrounding areas.

Yet, most such evaporator drain lines include a right angle fitting somewhere between the outlet end and the connection at the evaporator pan or air handler plenum. Moreover, such lines are generally formed of PVC plastic pipe with connections being cemented together to form a permanent installation. This requires the pipe to be cut apart in order to run a plumber's snake or other cleanout tool through the pipe, thus resulting in a relatively labor intensive and time consuming job. The alternative of flushing or blowing the blockage from the line cannot generally be used, as the line can generally only be easily accessed from its outlet end, thus resulting in blowing the blockage back into the evaporator pan and creating an unacceptable flow of water into the already flooded pan, if water is used. Moreover, such blowout and flushing methods often do not completely clean out a blocked area, but only remove a part of the blockage, with the relatively narrow cleared area being prone to further blockage in the immediate future.

Accordingly, a need will be seen for a cleanout fitting for an air conditioner evaporator drain, to allow the drain line to be accessed completely for thorough cleaning. An evaporator drain line equipped with the present fitting, does not need to be cut for cleanout purposes. Moreover, the present fitting with its selector valve enables all of the line downstream of the valve to be flushed or blown out with high pressure water or air, as desired. Opening the valve allows a cleanout tool or snake to be passed through that portion of the line all the way into the evaporator pan, in order to physically remove any blockage or obstruction therein.

A discussion of the related art of which the present inventor is aware, and its differences and distinctions from the present invention, is provided below.

U.S. Pat. No. 1,274,103 issued on Jul. 30, 1918 to Frank Story, titled "Device For Cleaning Pipes," describes a cleanout fitting comprising a rotary valve with a hollow shaft for blowing steam under high pressure through the valve and the attached pipes. The valve is installed in line in the pipe, with no T fitting provided for drainage. No removable cap is provided at one end of the line for the insertion of a cleanout tool through the pipe, whereas the present fitting includes such a removable cap at one end of the fitting to allow a cleanout tool to be inserted essentially straight through the fitting and pipe upstream of the fitting. Even if the pipe sections were disconnected, the male ends would not provide for the attachment of a male garden hose coupling, as provided by the present fitting.

U.S. Pat. No. 1,655,796 issued on Jan. 10, 1928 to Robert N. Murphy, titled "Plumbing Fitting," describes a fitting installed in the stem of a T in a plumbing line. The device permits the line to be flushed, but only in one direction at a time, depending upon the orientation of the valve of the fitting. In contrast, the valve of the present fitting may be opened completely, to allow flow in either direction and the passage of a cleanout tool straight therethrough. The Murphy valve fitting must be removed for normal flow through the pipe due to the one way nature of the valve and consequent blockage of flow through the pipe, whereas the present fitting remains in place at all times and provides for normal use of the drain.

U.S. Pat. No. 4,203,460 issued on May 20, 1980 to Werner K. Priese, titled "Ball Valve With Compound Closure Movement," describes a tapered seat valve for use in the food industry, for relatively high pressure flow. The Priese valve may be lifted slightly from its seat to relieve pressure on the seat, for easier turning of the valve. The Priese valve is not a T fitting, but includes a cleanout passage to the interior of the valve body. However, the relationship of the cleanout plug and passage and the valve, results in any flow introduced through the cleanout passage flowing in both directions through the line to either side of the valve, or no flow to either side. In contrast, the present fitting provides for flow in one direction when the valve is closed, and another when the valve is open. Also, Priese does not provide any means for attaching a conventional hose to his fitting.

U.S. Pat. No. 4,553,566 issued on Nov. 19, 1985 to John A. Barclay et al., titled "Rotary Multiposition Valve," describes a valve having multiple inlets and outlets, with rotation of the valve resulting in flow through a predetermined pair of the inlet and outlet lines. All of the lines are radially disposed, with no axial flow being possible completely through the Barclay et al. valve, unlike the present fitting. The Barclay et al. valve does not have a T configuration, and no fitting or means for attaching a conventional male connector from a garden hose is provided by Barclay et al. for his valve, whereas the present generally T shaped fitting includes such hose attachment means at one end of the crossmember portion of the T.

U.S. Pat. No. 4,998,412 issued on Mar. 12, 1991 to Joel Bell, titled "Blockage Alert And Purge System," describes a system for cleaning out air conditioner evaporator drain lines, including a T fitting installed in the line. However, the crossmember of the T is in continuous communication with the drain line, and as a result is inaccessible in a straight line, whereas the present fitting allows access for mechanical cleanout through one end of the T crossmember. Bell provides access to the line interior through the stem of the T, but thus requires high pressure fluid (air) to be blow through the line, as it is not possible to pass a mechanical cleanout tool past the ninety degree bends in the fitting. Moreover, Bell does not provide for connection to a conventional garden hose for economical flushing of the system, as provided by the present device.

U.S. Pat. No. 5,085,244 issued on Feb. 4, 1992 to Douglas H. Funk, titled "Assembly For Cleaning A Drain Conduit," describes a device having a T fitting located to each side of a generally centrally disposed valve. As the cleanout fittings are disposed at right angles to the line, a mechanical cleanout tool cannot be readily passed through the fittings to be run through the pipe, as provided by the present invention. Funk utilizes a vacuum to draw any blockage from the downstream side of the assembly, but utilizes high pressure air to blow back through the upstream side. The oftentimes only partial effectiveness of such blowout technique has been noted further above, and moreover, tends to blow the foreign matter far into the evaporator drain pan or plenum where it may flow back to the drain again in the near future.

U.S. Pat. No. 5,722,458 issued on Mar. 3, 1998 to Andrew M. Potter, titled "Valve For Clearing Air Conditioning Drain Lines," describes an in-line fitting providing for flow through the valve, or cutting off either side of the line from the valve as desired. Pressure or vacuum may be introduced into the top of the valve to attempt to remove a blockage in either direction, depending upon the orientation of the valve. The arrangement is more closely related to the assembly of the '103 U.S. patent to Story, discussed further above, than to the present invention. The configuration of the Potter valve does not permit a mechanical cleanout tool to be run straight through the line, as provided by the present fitting, nor can the Potter valve be economically flushed using a garden hose, as provided by the present fitting.

Canadian Patent Publication No. 482,593 issued on Apr. 22, 1952 to Archibald N. MacArthur, titled "Drain Pipe Blow-Out Plug," describes another assembly more closely related to the device of the Story '103 U.S. patent discussed further above, than to the present invention. The MacArthur assembly also provides a hollow valve stem, through which a fluid under pressure is introduced to the line to either side of the valve, depending on the orientation of the valve. The only access is through the hollow valve stem, with the stem oriented as the stem of a T in the line. Thus, no mechanical means may be readily used to pass straight through the crossmember of the T, as provided by the present fitting. Also, any fluid under pressure toward the upstream end of the assembly creates a backflow, flushing contaminants back to the drain pan where they will likely clog the drain again in short order; this problem is noted in other devices discussed further above as well.

Finally, British Patent Publication No. 2,212,597 published on Jul. 26, 1989 to Anthony T. Kirby-Suttle, titled "Control Valve For Fluid Flow," describes a spherical valve with two rotational axes. This allows the valve to align with one or the other openings through the valve body sides, normally used for rotating the valve. This allows a fluid to be passed into the valve to neutralize the effects of chemicals in the line. No T fitting is provided, nor is any means provided for the insertion of a mechanical cleanout tool straight through the valve, as provided by the present fitting.

None of the above inventions and patents, either singly or in combination, is seen to describe the instant invention as claimed.

SUMMARY OF THE INVENTION

The present invention comprises a cleanout fitting for air conditioner evaporator drains, providing for the complete mechanical and hydraulic cleaning of the drain line. The present fitting essentially comprises an asymmetric T fitting, with a spherical valve in one side of the crossmember portion and a removable plug in the opposite crossmember end. The valve side of the crossmember is connected to the line from the evaporator pan, and the stem is connected to an outlet line to a suitable drain.

During normal operation, the valve remains open to allow flow from the evaporator pan, with the opposite crossmember end of the T remaining closed by means of the plug. When cleanout of the drain line is required, the plug is removed and a mechanical cleanout tool (snake) is passed through the straight section of the crossmember portion of the T, and through the open valve and into the drain line to the evaporator pan. The straight configuration of the line from the plug opening to the evaporator pan makes possible the use of a mechanical tool for cleanout of this portion of the line.

Once free flow has been confirmed from the pan to the fitting, the valve is turned to shut off flow from the pan and a source of water under pressure (conventional garden hose, or other suitable means) is screwed into the end of the crossmember to temporarily replace the plug. The water is turned on, and with the valve in the opposite crossmember side closed, water under pressure flushes any debris from the stem of the T fitting and out the drain line.

The present cleanout fitting is easily manufactured of PVC plastic pipe or other suitable economical materials, as it is not subjected to high pressure. The present fitting greatly simplifies evaporator drain cleanout procedures, as no cutting or other disassembly of permanently connected parts is required. Cleanout of an evaporator drain line requires only a few minutes when equipped with the present fitting, thus greatly reducing maintenance costs for such a system.

Accordingly, it is a principal object of the invention to provide an improved cleanout fitting for air conditioner evaporator drains, comprising an asymmetric T fitting with a shutoff valve in one side of the T crossmember and a removable plug in the opposite crossmember side.

It is another object of the invention to provide an improved cleanout fitting providing a straight through passage along the crossmember portion for easily passing a mechanical cleanout tool therethrough.

It is a further object of the invention to provide an improved cleanout fitting which removable plug is threaded identically to the male end of a garden hose, allowing a garden hose to be connected to the fitting for hydraulically flushing the drain system downstream of the fitting.

An additional object of the invention is to provide an improved cleanout fitting formed of polyvinyl chloride plastic material, or other suitable material as desired.

Still another object of the invention is to provide an improved method of cleaning out an air conditioner evaporator drain line, incorporating the present fitting and utilizing mechanical and hydraulic flushing means for the complete cleanout of the drain line in both directions from the fitting.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a cleanout fitting or device for installation in the evaporator drain line of an air conditioning system, particularly such systems as installed in stationary structures (homes, office buildings, etc.) . In such systems, the evaporator units (or air handlers) chill the air passing thereover to a temperature close to freezing, which causes moisture being carried in the air to condense out and run off the evaporator coils as a liquid. This liquid is collected in the drain pan of the evaporator and drained off to a suitable drain by means of a drain line.

These drain lines generally include one or more right angle bends, as they turn from the evaporator pan and/or drop vertically into a drain system. These lines will become clogged with debris (dust, dirt, etc.) from time to time, and generally require some cutting of the lines for access when they become clogged, as the components are generally formed of PVC (polyvinyl chloride) plastic or the like, and are cemented permanently together using a solvent.

Figure 1:
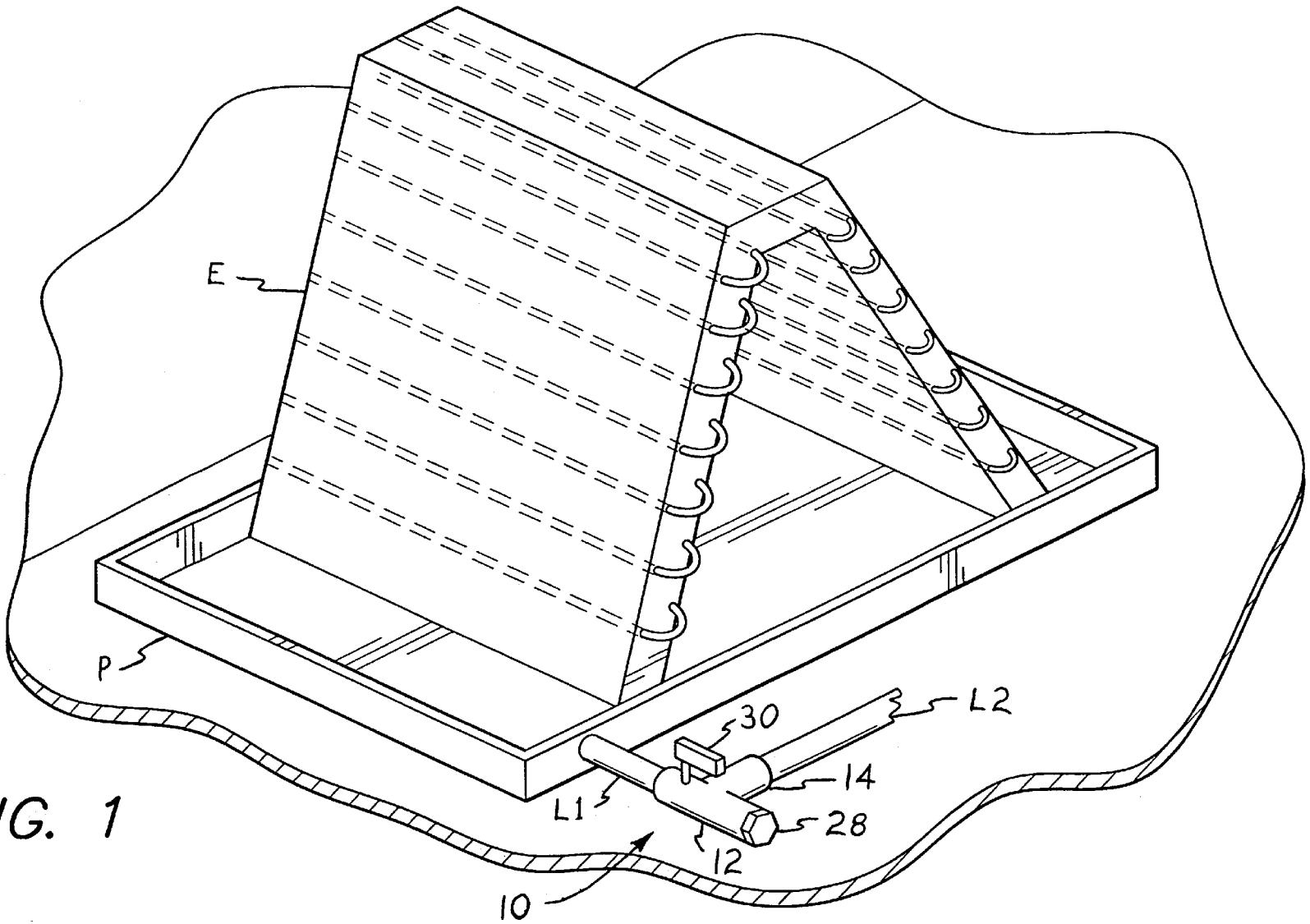
FIG. 1 is a broken away perspective view of an air conditioning evaporator and pan, including a drain line with the cleanout fitting of the present invention installed therein.

The present invention overcomes this problem by providing a generally T-shaped fitting 10, which is installed in the evaporator drain line, generally as shown in FIG. 1 of the drawings. In FIG. 1, the air conditioning evaporator E rests above a drain pan P, with condensate collecting in the pan P and draining therefrom by means of a first or upstream drain line L1. The line L1 is connected to the fitting 10, with the liquid runoff passing through the fitting 10 to a second or downstream drain line L2.

Figure 2:
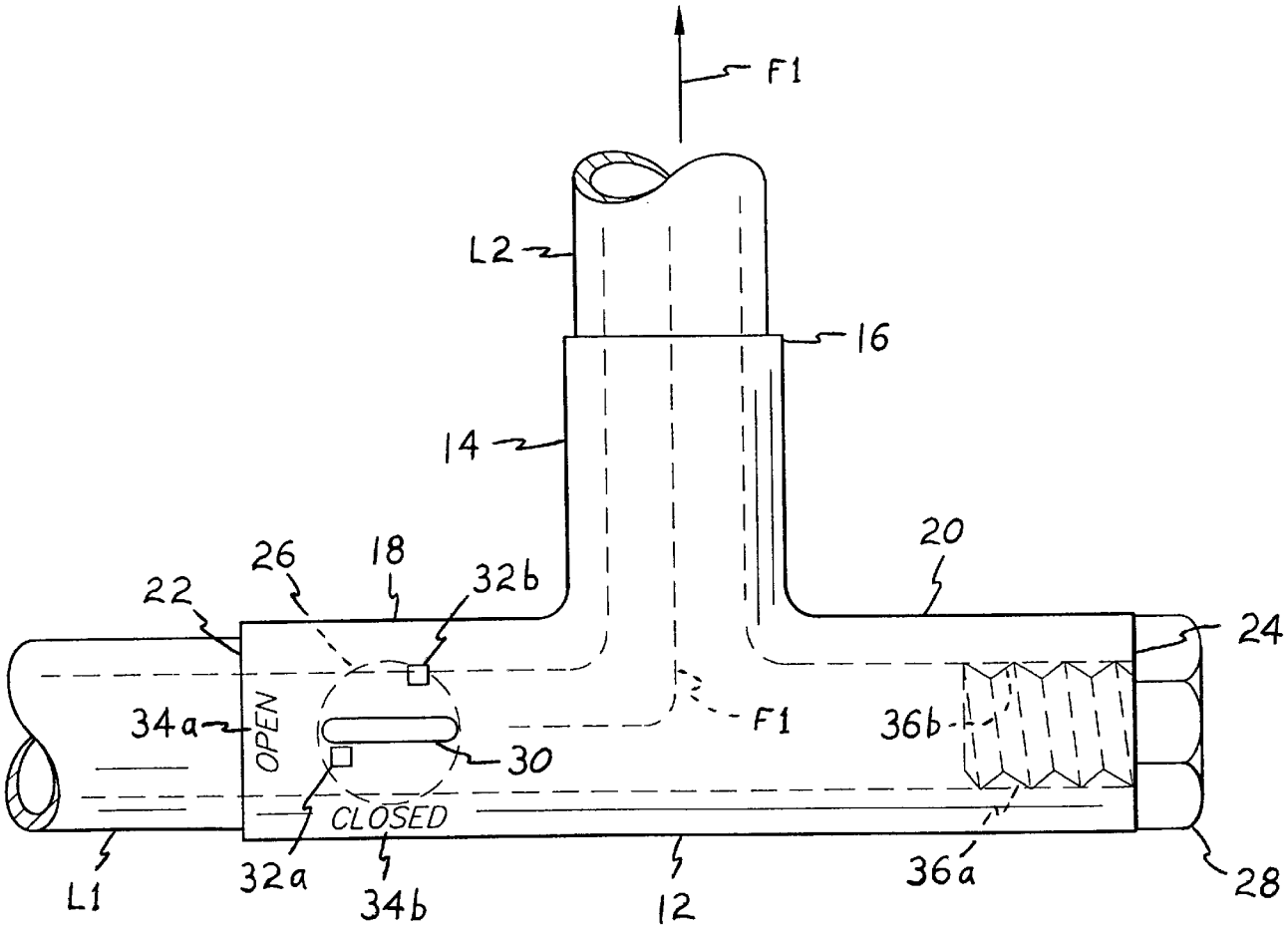
FIG. 2 is a detailed top plan view of the present cleanout fitting, showing further details thereof and normal flow therethrough.

FIG. 2 of the drawings provides a top plan view of the T fitting 10 of the present invention in its normal state, permitting flow from the evaporator E and pan P through the fitting 10 and second drain line L2 to an appropriate drain (not shown). The T fitting 10 generally comprises a straight crossmember portion 12 with a stem portion 14 extending therefrom, with the stem portion 14 having a distal end 16 connected to the downstream drain line L2. The crossmember portion 12 has a first arm 18 and an opposite second arm 20, with the two arms 18 and 20 respectively having a first end 22 and a second end 24. It will be noted that the T fitting 10 has an asymmetric configuration, as the first arm 18 includes a shutoff valve 26 therein and the opposite second arm 20 includes a plug 28 removably installed in the second end 24. Also, while the stem portion 14 is shown attached generally medially to the crossmember 12, it will be seen that the second arm 20 may be shortened as desired, so long as sufficient length is provided for the installation of the plug 28.

The shutoff valve 26 is preferably a ball-type valve, with a spherical valve core with a lateral passage therethrough of a diameter equal to the inside diameter of the crossmember portion 12 of the fitting 10. In this manner, the passage through the crossmember 12 is completely unobstructed when the valve 26 is completely open, with the walls of the valve passage aligning with the interior walls of the crossmember 12. This is important to provide clearance for mechanical cleanout means, as described further below. However, other valve types may be used, if desired.

The valve 26 includes an externally disposed elongate handle 30, for manipulating the valve 26 and also indicating the disposition or orientation of the valve 26. Two stops 32*a* and 32*b* protrude from the outer surface of the crossmember first arm 18, adjacent the handle 30. The open stop 32*a* and closed stop 32*b* are positioned approximately ninety degrees from one another (allowing for the thickness of the handle 30), to limit rotation of the handle 30 and internal valve body within the crossmember first arm 18 to a quarter turn movement between the first or fully opened position (shown in FIGS. 2 and 3) and the second or fully closed position (shown in FIG. 4). Some means for indicating the position of the valve 26 in either the open or closed position is also desired, such as the word "OPEN" 34*a* positioned to be aligned with the handle 30 when the valve 26 is in the open position, and the word "CLOSED" 34*b* positioned to be aligned with the handle 30 when the valve 26 is in the closed position.

Figure 4:
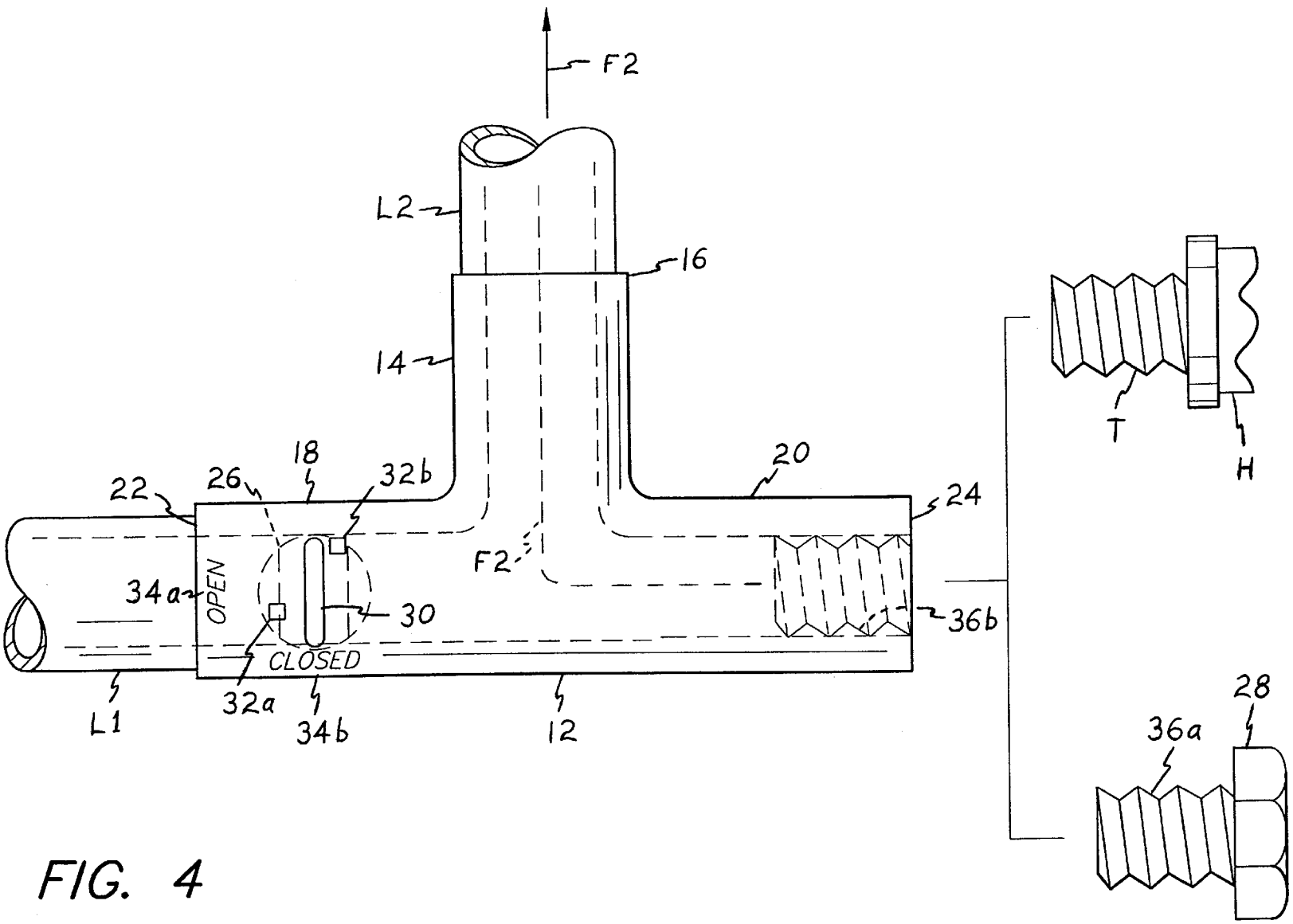
FIG. 4 is a detailed top plan view of the cleanout fitting, showing the temporary installation of a hose thereto for hydraulically flushing the line downstream of the fitting.

The opposite second arm 20 of the crossmember 14 provides for the removable installation of a plug 28 into the second end 24, as noted further above. The plug 28 has external threads 36*a* identical to the conventional rolled threads T found on the connection end of a conventional garden hose H, as shown in FIG. 4 of the drawings. Accordingly, the internal threads 36*b* of the second crossmember end 24 are configured to mate tightly with the threads T of a hose H, to provide water under pressure for flushing the assembly when required. (The threads 36*a*, 36*b*, and T are shown schematically in the drawing Figures.)

FIG. 2 of the drawings illustrates the present fitting 10 configured in its normal position, with the valve 26 open to allow water flow from the inlet line L1, through the first arm 18 of the T crossmember 12, and out the stem 14 of the T to continue through the outlet line L2. This flow path is shown by the flow line and arrow F1 in FIG. 2. Flow cannot continue along the second arm 20 of the crossmember 12, as the plug 28 is installed within the second end 24 and precludes any flow therefrom.

Figure 3:
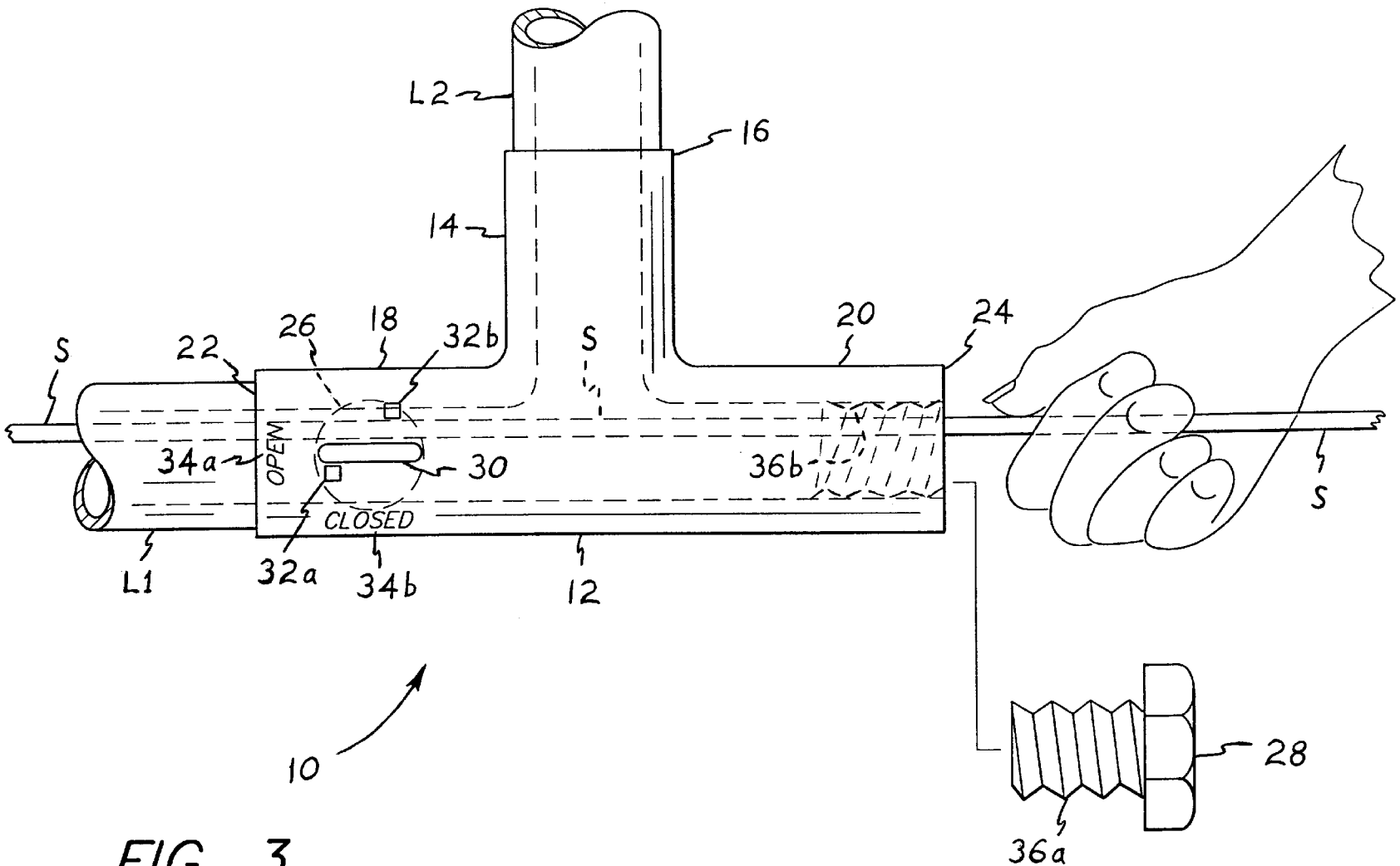
FIG. 3 is a detailed top plan view of the cleanout fitting, showing the passage of a mechanical cleanout tool therethrough.

In the event the line(s) and/or fitting become clogged at any point(s) therein, the present fitting 10 enables a person to clear the entire drain system quickly and easily, without need to cut any of the components apart for access, as is done in many conventional systems. FIG. 3 illustrates the procedure involved in cleaning out the upstream line L1 and T crossmember 12, if a blockage has occurred in either of those components. After confirming that the shutoff valve 26 is open (required for normal flow and also for mechanical cleanout operations), the plug 28 is removed from the second end 24 of the crossmember arm 20 for access to the interior of the crossmember 12 and its connected upstream drain line L1. As these two components are assembled in an essentially straight path, it is a simple matter to insert a mechanical cleanout tool (plumber's snake S, or a rod, etc.) into the second end 24 of the crossmember 12 and through the upstream drain line L1, as shown in FIG. 3 of the drawings. The straight path of the assembly, shown in FIG. 1 of the drawings, ensures that all blockage may be positively cleared from the crossmember 12 and upstream line L1.

Once all debris and obstructive matter has been cleared from the crossmember portion 12 of the fitting 10 and its connected upstream drain line L1, the stem 14 and downstream line L2 may then be cleared. This is accomplished by removing the snake S so the valve 26 may be completely closed, as shown in FIG. 4 of the drawings. When the valve 26 has been closed, a source of pressurized water (preferably a conventional garden hose H connected to a suitable tap, hose bib, etc.) is connected to the second end 24 of the fitting crossmember 12. The provision of internal threads 36*b* having a rolled configuration in the second end 24 of the crossmember 12, enables the conventional rolled threads T of the male connector end of the hose H to be threaded securely into the second end 24 of the crossmember 12. The water is then turned on, and the water pressure hydraulically flushes any debris and obstructions from the stem portion 14 of the fitting 10 and through the outlet drain line L2 to the drain for the system. Water cannot flow back upstream to the evaporator drain pan P through the upstream line L1, as the valve 26 is closed during this portion of the operation.

Once a good flow has been established through the outlet line L2, as indicated by the flow path and arrow F2 of FIG. 4, the water supply may be shut off and the hose H disconnected from the second end 24 of the fitting crossmember 12. The plug 28 is reinstalled and the valve 26 again opened, and the system checked for flow from the drain pan P, through the T fitting 10, and out the outlet drain line L2.

In summary, the present cleanout fitting provides a much needed means for a plumber or other person to quickly and easily remove and flush any debris from the drainage lines of an air conditioner evaporator drain system. Conventionally, such systems are formed of PVC (polyvinyl chloride) plastic pipe, with joints being permanently assembled by means of a solvent cement. This requires the system to be cut apart for access to the interior of the drain lines, resulting in high labor and material costs for opening the system and for repair of the system once it has been cleaned out. The present system, once installed, does not require any cutting or damaging of parts or components of the drain system, as is often the case with conventional evaporator drain systems. Accordingly, the present system, comprising the T fitting and inlet and outlet lines, may be formed of PVC material as well, but will not require disassembly beyond the closing and opening of the valve and removal and reinstallation of the plug.

With the present fitting, the entire system may be mechanically and hydraulically cleaned in a matter of a few minutes, with all operable and removable components (shutoff valve and plug) being easily returned to their normal state for normal flow operation in a few seconds. Accordingly, the present fitting will pay for itself in short order after installation, in terms of the time saved for future drain cleanout operations.

It is to be understood that the present invention is not limited to the sole embodiment described above, but encompasses any and all embodiments within the scope of the following claims.

I claim:

1. A cleanout device for an air conditioner evaporator drain line, comprising:

an asymmetric T fitting having a straight crossmember with a stem extending therefrom for connecting to a downstream drain line;

said crossmember having a first arm for receiving condensate flow from the air conditioner evaporator, and a second arm opposite thereto;

said first and said second arm respectively having a first end for connecting to an upstream drain line and an opposite second end;

a selectively operable shutoff valve disposed within said first arm of said crossmember. said shutoff valve being operable between an open position and a closed position; and a removable plug installed in said second end of said crossmember, wherein said second end of said crossmember is internally threaded and dimensioned for compatible connection with a male threaded end of a conventional garden hose; whereby upon removal of the plug and with the shutoff valve is in the open position, a cleanout tool is passed through the crossmember of the fitting and through the upstream drain line to mechanically remove any debris disposed therein, then upon removal of the cleanout tool and with the shutoff valve in the closed position, the garden hose is connected to the second end of the crossmember to hydraulically flush the second arm of the crossmember, the stem of the fitting, and the downstream drain line of any debris disposed therein.

2. The cleanout device according to claim 1, wherein said shutoff valve comprises a ball valve providing an unobstructed passage through said crossmember when said valve is completely open.

3. The cleanout device according to claim 1, including an externally disposed handle for said valve and stop means disposed upon said first arm of said crossmember for limiting travel of said handle to a first fully open position and a second fully closed position for said valve.

4. The cleanout device according to claim 3, including means for indicating when said valve is in a fully open and a fully closed position.

5. The cleanout device according to claim 1, wherein said T fitting is formed of polyvinyl chloride plastic material.

6. An air conditioner evaporator drain line assembly for draining condensate fluid from an air conditioner evaporator, comprising:

an asymmetric T fitting having a straight crossmember with a stem extending therefrom for connecting to a drain, said stem including a distal end connected to an outlet line extending to the drain;

said crossmember having a first arm for receiving condensate flow from the air conditioner evaporator, and a second arm opposite thereto;

said first and said second arm respectively having a first end connected to an inlet line extending from the evaporator and an opposite second end;

a selectively operable shutoff valve disposed within said first arm of said crossmember, said shutoff valve being operable between an open position and a closed position; and a removable plug installed in said second end of said crossmember, wherein said second end of said crossmember is internally threaded and dimensioned for compatible connection with a male threaded end of a conventional garden hose; whereby upon removal of the plug and with the shutoff valve is in the open position, a cleanout tool is passed through the crossmember of the fitting and through the inlet line to mechanically remove any debris disposed therein, then upon removal of the cleanout tool and with the shutoff valve in the closed position, the garden hose is connected to the second end of the crossmember to hydraulically flush the second arm of the crossmember, the stem of the fitting, and the outlet line of any debris disposed therein.

7. The drain line assembly according to claim 6, wherein said shutoff valve comprises a ball valve providing an unobstructed passage through said crossmember when said valve is completely open.

8. The drain line assembly according to claim 6, including an externally disposed handle for said valve and stop means disposed upon said first arm of said crossmember for limiting travel of said handle to a first fully open position and a second fully closed position for said valve.

9. The drain line assembly according to claim 8, including means for indicating when said valve is in a fully open and a fully closed position.

10. The drain line assembly according to claim 6, wherein said T fitting and said first and said second drain line are formed of polyvinyl chloride plastic material.

11. A method of cleaning out an air conditioner evaporator drain line, comprising the following steps:

(a) providing a T fitting having a straight crossmember with a stem extending therefrom for connecting to a drain, with the crossmember further having first and second arms extending from each side of the stem;

(b) further providing a first drain line extending from the evaporator to the first arm of the crossmember, and connected thereto;

(c) further providing a second drain line extending to the drain, and connected to the stem of the fitting;

(d) further providing a shutoff valve within the first arm of the crossmember, and a removable plug in the end of the second arm of the crossmember;

(e) confirming that the shutoff valve is open;

(f) removing the plug from the end of the second arm of the crossmember and passing a mechanical cleanout tool straight through the crossmember of the fitting and through the first drain line connected thereto to the evaporator, and mechanically removing any debris disposed within the first drain line and crossmember;

(g) removing the mechanical cleanout tool from the first drain line and fitting, and closing the valve;

(h) providing a source of selectively pressurized water;

(i) connecting the water source to the end of the second arm of the crossmember, activating the water pressure, and hydraulically flushing the second arm of the crossmember, the stem of the fitting, and the second drain line connected thereto and extending therefrom and hydraulically removing any debris disposed therein;

(j) depressurizing the water source, and removing the water source from the end of the second arm of the crossmember;

(k) reinstalling the plug in the end of the second arm of the crossmember; and (l) opening the valve.

12. The method of cleaning out an air conditioner evaporator drain line according to claim 11, further including the step of providing a ball valve for providing an unobstructed passage through the crossmember when the valve is completely open.

13. The method of cleaning out an air conditioner evaporator drain line according to claim 11, further including the steps of:

(a) providing an externally disposed handle for the valve; and (b) further providing stop means disposed upon the first arm of the crossmember for limiting travel of the handle to a first fully open position and a second fully closed position for the valve.

14. The method of cleaning out an air conditioner evaporator drain line according to claim 13, further including the step of providing means for indicating when the valve is in a fully open and a fully closed position.

15. The method of cleaning out an air conditioner evaporator drain line according to claim 11, further including the steps of:

(a) internally threading the second end of the crossmember for compatibly connecting the male threaded end of a conventional garden hose thereto; and (b) providing a garden hose connected to a suitable water supply for the selectively pressurized water source.

16. The method of cleaning out an air conditioner evaporator drain line according to claim 11, further including the step of forming the T fitting and the first and second drain lines of polyvinyl chloride plastic material.

* * * * *